US009828167B2

(12) United States Patent
Lewis

(10) Patent No.: US 9,828,167 B2
(45) Date of Patent: Nov. 28, 2017

(54) SOAP DISH CARROUSEL CARTRIDGE AND DISPENSER

(71) Applicant: GM Global Technology Operations LLC, Detroit, MI (US)

(72) Inventor: Neal A. Lewis, Dearborn Heights, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 162 days.

(21) Appl. No.: 14/463,932

(22) Filed: Aug. 20, 2014

(65) Prior Publication Data

US 2016/0052698 A1 Feb. 25, 2016

(51) Int. Cl.

| | |
|---|---|
| ***G07F 11/00*** | (2006.01) |
| ***B65H 3/44*** | (2006.01) |
| ***B65D 83/04*** | (2006.01) |
| ***B65D 83/08*** | (2006.01) |
| ***B65D 43/18*** | (2006.01) |

(52) U.S. Cl.

CPC ..... *B65D 83/04* (2013.01); *B65D 43/18* (2013.01); *B65D 83/0409* (2013.01); *B65D 83/08* (2013.01)

(58) Field of Classification Search

CPC ..... B65D 83/04; B65D 71/36; B65D 83/04; B65D 43/18; B65D 83/0409; B65D 83/08; A61J 7/04; A47K 5/009; A47K 5/00

USPC ..... 221/195

See application file for complete search history.

(56) References Cited

U.S. PATENT DOCUMENTS

| | | | | |
|---|---|---|---|---|
| 629,505 | A * | 7/1899 | Hollands | G07F 5/24 194/294 |
| 736,980 | A * | 8/1903 | Kneedler | G07F 11/54 221/121 |
| 3,804,294 | A * | 4/1974 | Householder | G07F 11/44 221/154 |
| 4,572,403 | A * | 2/1986 | Benaroya | A61J 7/04 221/15 |
| 5,280,845 | A * | 1/1994 | Leight | G07F 11/44 221/1 |

(Continued)

FOREIGN PATENT DOCUMENTS

| | | |
|---|---|---|
| CN | 2712144 Y | 7/2005 |
| CN | 202743710 U | 2/2013 |

(Continued)

OTHER PUBLICATIONS

Chinese Office Action dated Dec. 29, 2016 ; Application No. 201510513152.6; Applicant: GM Global Technology Operations LLC.; 11 pages.

*Primary Examiner* — Rakesh Kumar

(74) *Attorney, Agent, or Firm* — BrooksGroup

(57) ABSTRACT

A number of variations may include a product comprising a carrousel cartridge comprising a bottom compartment; an inner case, wherein the inner case is rotatably attached to the bottom compartment and is constructed and arranged to accommodate at least one component; and a top compartment, wherein the top compartment and the bottom compartment are slideably attached together, and a carrousel cartridge dispenser comprising a housing; an indexing cam system, wherein the indexing cam system is disposed within the housing; and a dispenser trough, wherein the dispenser trough is attached to the housing.

8 Claims, 4 Drawing Sheets

(56) References Cited

U.S. PATENT DOCUMENTS

| | | | | | |
|---|---|---|---|---|---|
| 6,021,918 | A * | 2/2000 | Dumont | A61J 7/0481 | 221/132 |
| 6,145,697 | A * | 11/2000 | Gudish | A61J 7/0481 | 221/3 |
| 6,189,731 | B1 * | 2/2001 | Schmitt | A61F 15/001 | 221/103 |
| 6,427,865 | B1 * | 8/2002 | Stillwell | G07F 11/54 | 221/113 |
| 6,427,867 | B1 * | 8/2002 | Frebes | B65D 83/02 | 221/191 |
| 6,431,399 | B2 * | 8/2002 | Gabel | A61J 7/0084 | 221/263 |
| 6,637,619 | B2 * | 10/2003 | Chang | G07F 11/54 | 221/155 |
| 6,824,011 | B1 * | 11/2004 | Woempner | F41B 11/50 | 221/263 |
| 9,045,272 | B2 * | 6/2015 | Kim | B65D 83/0409 | |
| 9,150,346 | B1 * | 10/2015 | Aramian | A61J 7/0084 | |
| 2016/0001955 | A1 * | 1/2016 | Wang | B65D 83/0409 | 221/268 |
| 2016/0052698 | A1 * | 2/2016 | Lewis | B65D 83/04 | 221/195 |

FOREIGN PATENT DOCUMENTS

| | | | | |
|---|---|---|---|---|
| CN | 103328345 | A | 9/2013 | |
| KR | 20100002752 | A * | 1/2010 | |
| WO | WO 9701157 | A1 * | 1/1997 | B65D 83/0409 |

* cited by examiner

SOAP DISH CARROUSEL CARTRIDGE AND DISPENSER

TECHNICAL FIELD

The field to which the disclosure generally relates to includes shipping and assembly devices for components.

BACKGROUND

One or more components may require shipping and assembly devices.

SUMMARY OF ILLUSTRATIVE VARIATIONS

One variation may include a product comprising a carrousel cartridge comprising: a bottom compartment; an inner case, wherein the inner case is rotatably attached to the bottom compartment and is constructed and arranged to accommodate at least one component; and a top compartment, wherein the top compartment and the bottom compartment are slideably attached together.

Another variation may include a product comprising a carrousel cartridge dispenser comprising: a housing; an indexing cam system, wherein the indexing cam system is disposed within the housing; and a dispenser trough, wherein the dispenser trough is attached to the housing.

Another variation may include a method comprising assembly of components comprising: providing at least one carrousel cartridge to hold at least one component; operatively connecting the at least one carrousel cartridge to a carrousel cartridge dispenser; and activating the carrousel cartridge dispenser to dispense the at least one component into a trough in the carrousel cartridge dispenser.

Other illustrative variations within the scope of the invention will become apparent from the detailed description provided hereinafter. It should be understood that the detailed description and specific examples, while disclosing variations within the scope of the invention, are intended for purposes of illustration only and are not intended to limit the scope of the invention.

BRIEF DESCRIPTION OF THE DRAWINGS

Select examples of variations within the scope of the invention will become more fully understood from the detailed description and the accompanying drawings, wherein.

DETAILED DESCRIPTION OF ILLUSTRATIVE VARIATIONS

The following description of the variations is merely illustrative in nature and is in no way intended to limit the scope of the invention, its application, or uses.

Figure 1:
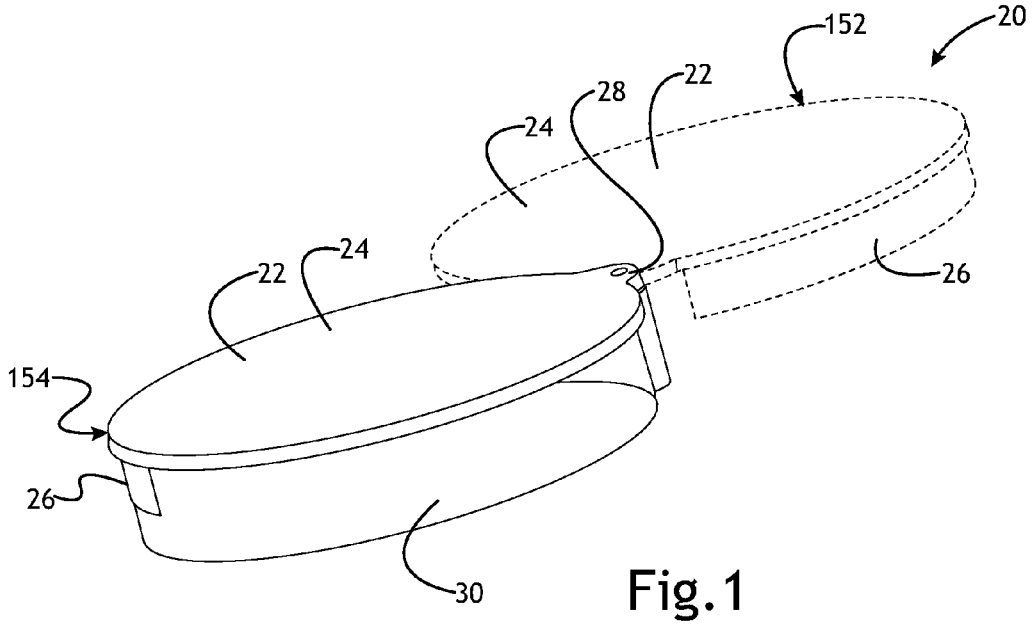
FIG. 1 illustrates a perspective view of a carrousel cartridge in an open position and a closed position according to a number of variations.
Figure 2:
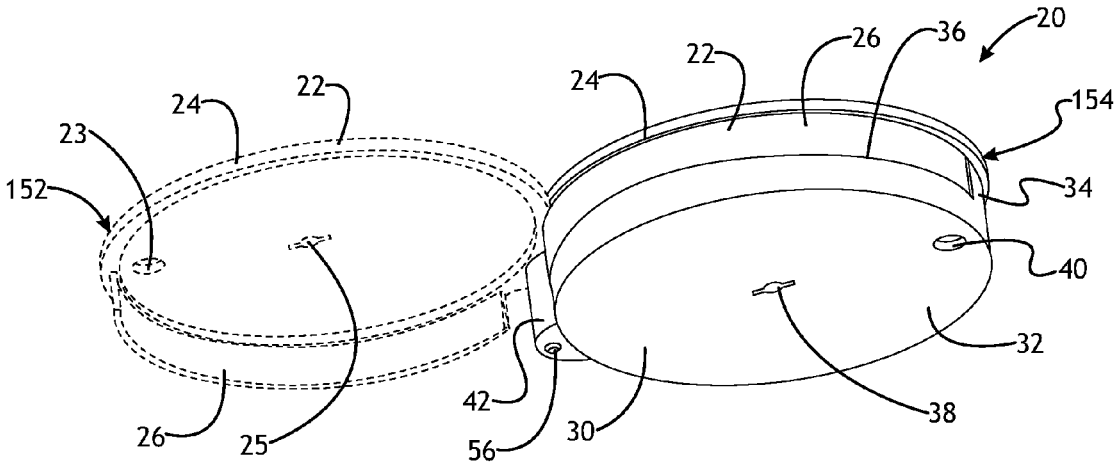
FIG. 2 illustrates a perspective view of a carrousel cartridge in an open position and a closed position according to a number of variations.
Figure 3:
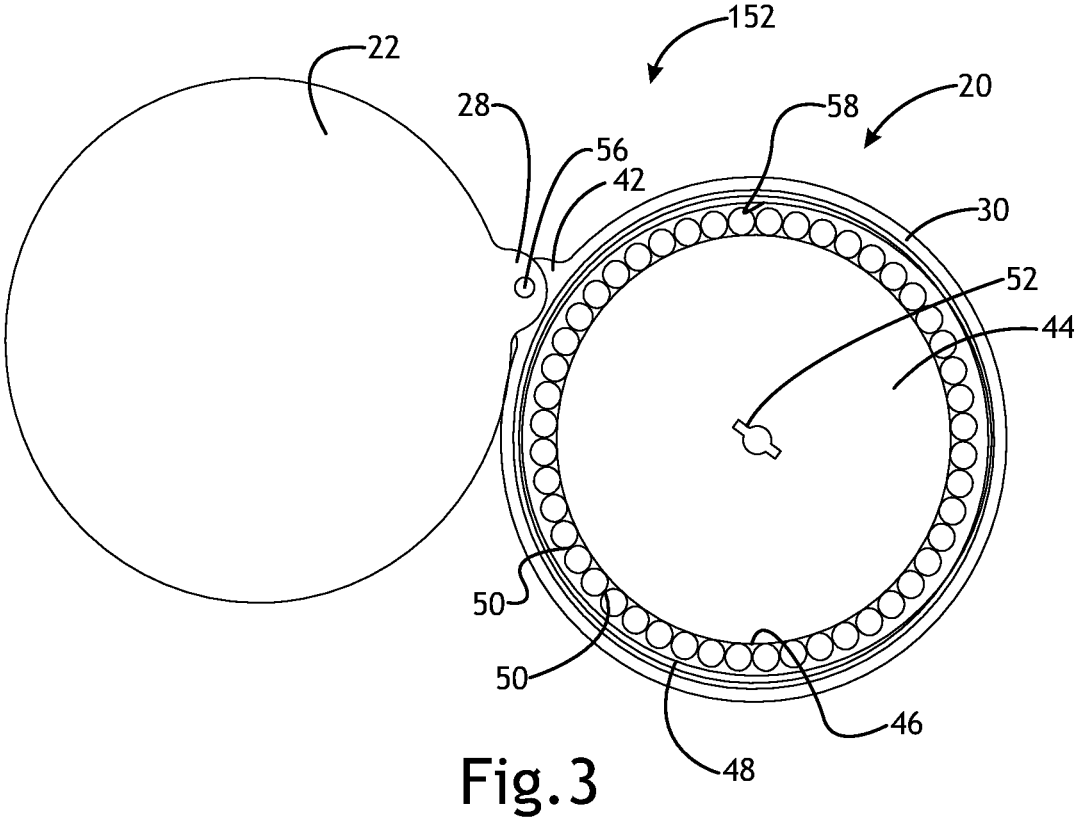
FIG. 3 illustrates a top view of a carrousel cartridge in an open position according to a number of variations.
Figure 6:
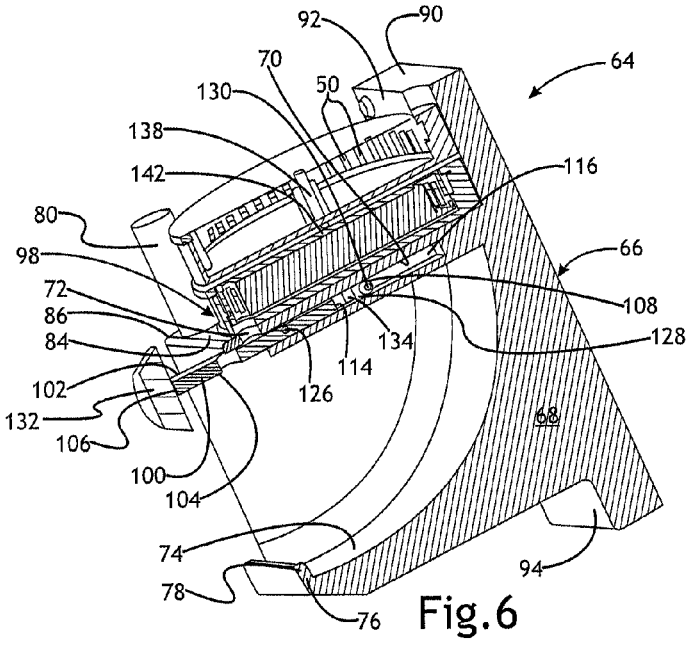
FIG. 6 illustrates a cut view of a carrousel cartridge dispenser according to a number of variations.

FIGS. 1-3 illustrate a number of variations. In one variation, a carrousel cartridge 20 may include a top compartment 22 and a bottom compartment 30. In a number of variations, the bottom compartment 30 may be constructed and arranged to house one or more components 58, including, but not limited to, vehicle components such as transmission valve body springs, valves, and cap components. The bottom compartment 30 may be circular in shape and may include a bottom surface 32 and a wall 34 which may extend upward from the bottom surface 32. The wall 34 may include a cutout 36 along a portion of the wall 34 which may be constructed and arranged to accommodate a wall portion 26 on the top compartment 22 as will be discussed hereafter. An inner case 44 may be rotatably connected to the bottom surface 32, a variation of which is illustrated in FIG. 3. The inner case 44 may include a ring-shaped cutout or groove 46 adjacent the outer perimeter 48 of the inner case 44 which may be constructed and arranged to secure one or more components 58 in place in the bottom compartment 30 during shipping and/or assembly of the components 58. The cutout 46 may also include one or more protrusions 50 which may be spaced along the cutout 46 and which may further hold the one or more components 58 in place in the bottom compartment 30 and/or act as a divider between the components 58, a variation of which is best illustrated in FIG. 6. The one or more protrusions 50 may also assist in rotating the one or more components 58 within the bottom compartment 30 when the carrousel cartridge 20 is activated. The bottom surface 32 and inner case 44 may also each include a keyhole 38, 52 which may be located approximately central of each of the bottom surface 32 and the inner case 44. The keyhole 38, 52 may be constructed and arranged to mate with any number of paddle devices 142 which may be attached to a vertical shaft 138 and which may be used to turn the inner case 44, as will be discussed hereafter. The bottom surface 32 may also include an opening 40 which may allow a component 58 to drop from the carrousel cartridge 20 when activated by a machine or operator as will be discussed hereafter.

In a number of variations, the top compartment 22 may comprise a top surface 24 which may include a wall portion 26 which may be constructed and arranged to mate with the bottom compartment 30 cutout 36, which may seal the carrousel cartridge 20 when the carrousel cartridge 20 is in a closed position, which may prevent any components 58 which may be inside the carrousel cartridge 20 from coming out of the carrousel cartridge 20 and may also prevent or reduce contaminants from entering into the carrousel cartridge 20. In a number of variations, the top compartment 22 may also include a keyhole 25 which may be located approximately central of the top compartment 22, a variation of which is illustrated in FIG. 2, which may be constructed and arranged to accommodate a paddle device 142 which may be attached to the vertical shaft 138. The top compartment 22 may also include an opening 23, a variation of which is also illustrated in FIG. 2, which may allow one or more component(s) 58 from a second, third, etc. carrousel cartridge 20 to drop through the subsequent carrousel cartridge(s) 20 and into the carrousel cartridge dispenser 64. In another variation, the top compartment 22 may not include an opening 23 and/or a keyhole 25, variations of which are illustrated in FIGS. 1 and 3, such as when the carrousel cartridge 20 may be the single carrousel cartridge 20 used with the carrousel cartridge dispenser 20 or in a situation where the carrousel cartridge 20 is used as the top carrousel cartridge 20 where multiple carrousel cartridges 20 are used.

The top compartment 22 and the bottom compartment 30 may be rotatably attached to each other so that the carrousel cartridge 20 may be in an open position 152 (illustrated in phantom lines) or a closed position 154, variations of which are each illustrated in FIGS. 1 and 2. In one variation, the bottom compartment 30 may include a protrusion 42 which may extend vertically from the outer perimeter of the wall 34. The top compartment 22 may include a tab 28 which may extend from the perimeter of the top surface 24. The top compartment 22 and the bottom compartment 30 may then be rotatably secured together by a pin 56 which may extend through the tab 28 and the protrusion 42. The top compartment 22 and the bottom compartment 30 may then be opened 152 and closed 154 by sliding the top compartment 22 and bottom compartment 30 apart or together. In a number of variations, the carrousel cartridges 20 may provide proper orientation of the components 58. The carrousel cartridges 20 may also be reusable so that several shipments of components 58 may be made using the same carrousel cartridge 20.

Figure 4:
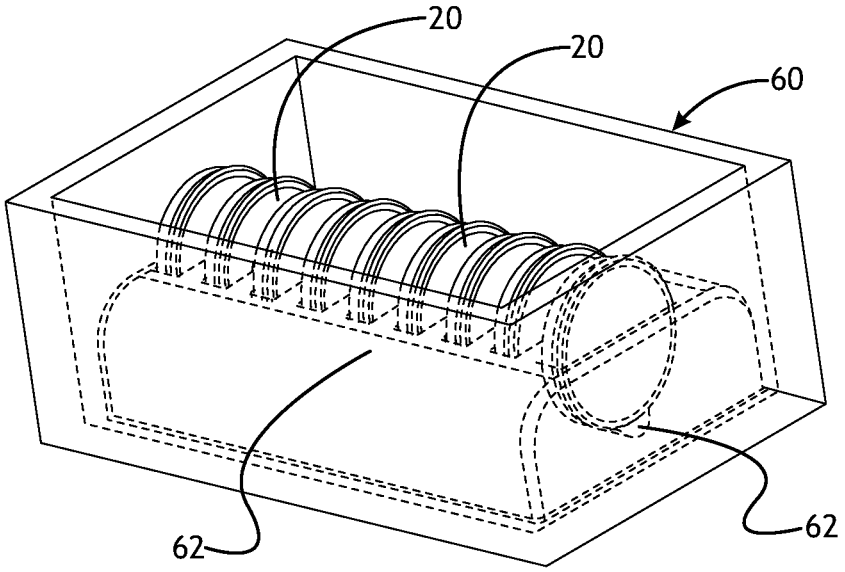
FIG. 4 illustrates a perspective view of a carrousel cartridge container according to a number of variations.

In a number of variations, one or more carrousel cartridges 20 may be shipped in a container or tote 60 having one or more carrousel cartridge compartments or pockets 62 which may allow the components 58 to be shipped and stored using reduced floor space. In one variation, the tote 60 may be a vacuum formed insert which may include a plurality of pockets 62 which may be constructed and arranged to hold one or more carrousel cartridges 20 in an upright position inside of the tote 60, a variation of which is illustrated in FIG. 4.

In a number of variations, each carrousel cartridge 20 may contain a different set of components 58. The carrousel cartridges 20 may be color coated or marked to indicate which set of components 58 are contained inside. In one variation, the carrousel cartridges 20 may be used for the shipping of transmission valve body springs, valves, and cap components.

Figure 5:
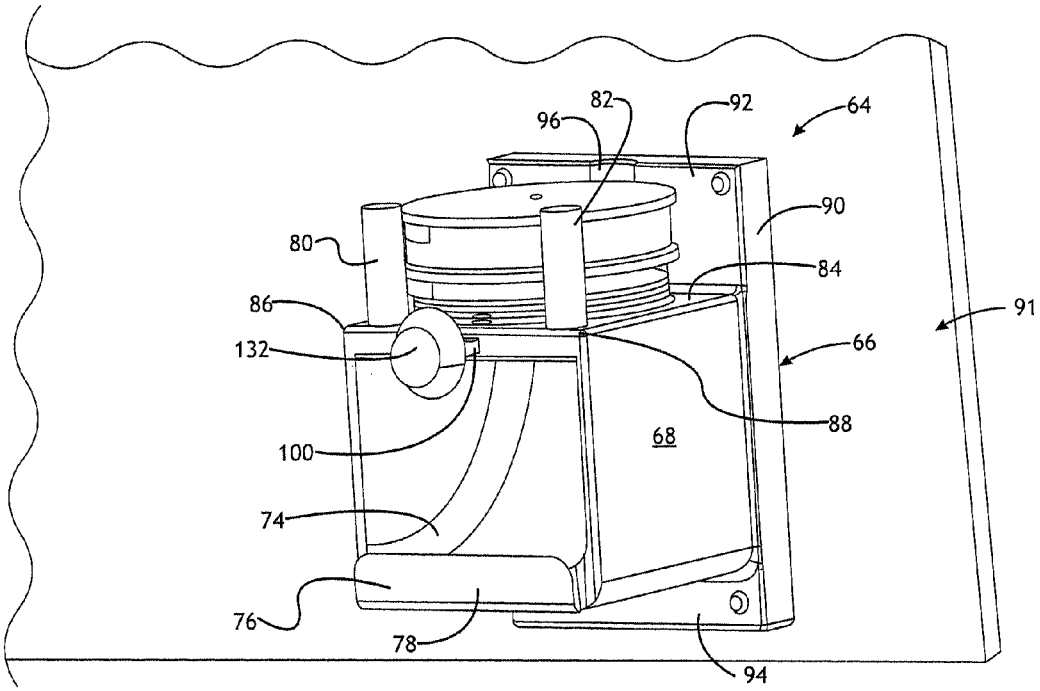
FIG. 5 illustrates a perspective view of a carrousel cartridge dispenser according to a number of variations.

Referring to FIGS. 5 and 6, in a number of variations, an operator may use a carrousel cartridge dispenser 64 to manually retrieve one or more components 58 from one or more carrousel cartridges 20. In a number of variations, a carrousel cartridge dispenser 64 may include a housing 66. The housing 66 may include a body 68 which may be attached to a back plate 90. The back plate 90 may include a top portion 92 and a bottom portion 94. In one variation, the back plate 90 may be constructed and arranged to attach to an assembly station 91. In another variation the body 68 may be constructed and arranged to attach to an assembly station 91. The housing 66 may comprise several pieces attached together or may comprise one continuously formed piece.

Figure 7:
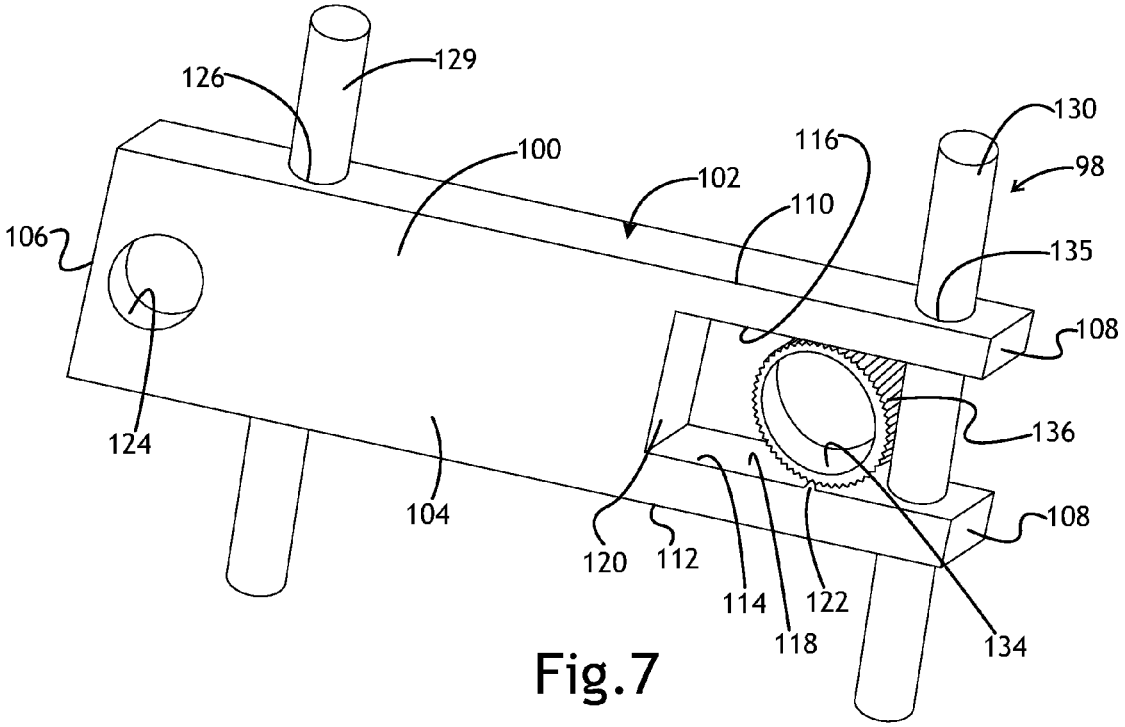
FIG. 7 illustrates a close-up view of an indexing cam system according to a number of variations.

In a number of variations, the housing body 68 may be constructed and arranged to house an indexing cam system 98 which may be used to dispense one or more components 58 from the carrousel cartridge dispenser 64, variations of which are illustrated in FIGS. 6 and 7. In a number of variations, the housing body 68 may include a channel or slot 70 which may be constructed and arranged to house a trap door slide 100, as will be discussed hereafter. The channel or slot 70 may be located approximately central of the housing body 68. The housing channel 70 may include a vertical opening or through-hole 72 which may be constructed and arranged so that when the trap door slide 100 is moved from a first position to a second position, one or more components 58 from one or more carrousel cartridges 20 may be released from the carrousel cartridge(s) 20 into the carrousel cartridge dispenser 64, as will be discussed hereafter. In one variation, the opening 72 in the housing channel 70 may allow one or more components 58 to drop into a chute 74 in the housing 66 which may direct the one or more components 58 out from the carrousel cartridge 20 into a dispensing trough 76 which may be attached to the housing 66, variations of which are illustrated in FIGS. 5 and 6. In one variation, the dispensing trough 76 may comprise a lip 78 which may extend upward from the housing body 68 so that it may collect one or more components 58 which may be dispensed from the carrousel cartridge dispenser 64. In another variation, the housing body 68 may include a tube or channel (not illustrated) which may further control and/or direct one or more components 58 to the chute 74 and into the dispensing trough 76.

In a number of variations, the indexing cam system 98 may be located in the housing body 66 and may include a spring-loaded trap door slide 100 which may be slideably located in the housing channel or slot 70. The trap door slide 100 may include a top surface 102, a bottom surface 104, a front surface 106, a rear surface 108, and a first and a second side surface 110, 112, a variation of which is illustrated in FIG. 7. A knob or button 132 may be used to activate the carrousel cartridge dispenser 64 to dispense one or more components 58 from one or more carrousel cartridges 20. The knob or button 132 may be attached to the front surface 106 of the trap door slide 100, a variation of which is illustrated in FIG. 6. Any number of variations of knobs or buttons 132 may be used. An opening 114 may be extend a distance inward from the rear surface 108 of the trap door slide 100 and may be constructed and arranged to accommodate a cam 134. The opening 114 may include a first and second side wall 116, 118 and a front wall 120. At least one of the first and/or second side walls 116, 118 may include a notch or protrusion 122 which may be constructed and arranged to mate with a notch or protrusion 136 on the cam 134 so that when the knob or button 132 is manually pushed by an operator, the notch or protrusion 122 on the first and/or second side wall 116, 118 may lock with the notch or protrusion 136 on the cam 134 which may hold the cam 134 in place once the knob or button 132 is released, as will be discussed hereafter.

In a number of variations, the trap door slide 100 may also include a vertical opening or through-hole 124 which may be constructed and arranged to allow one or more components 58 from the carrousel cartridge(s) 20 to drop into the carrousel cartridge dispenser 64 and into the chute 74. In one variation, the vertical opening or through-hole 124 may be located adjacent the front surface 106 of the trap door slide 100, a variation of which is illustrated in FIG. 7.

In a number of variations, the trap door slide 100 may also include a first horizontal through-hole 126 which may be adjacent the front surface 106 of the trap door slide 100 and may be constructed and arranged to accommodate a first roller 129. The trap door slide 100 may also include a second horizontal through-hole 128 which may be constructed and arranged to accommodate a second roller 130, a variation of which is illustrated in FIG. 6. The first and second rollers 129, 130 may improve the movement of the trap door slide 100.

In a number of variations, the trap door slide 100 may be operatively connected to a spring (not illustrated) which may be adjacent the rear surface 108 of the trap door slide 100 so that when the knob or button 132 on the trap door slide 100 is pushed in, it causes the trap door slide 100 to move from a first position to a second position, causing the spring to compress and wherein when the knob or button 132 is released, the trap door slide 100 may return to the first position by the force of the spring as it decompresses.

In a number of variations, the cam 134 may be operatively connected to a vertical shaft 138. The vertical shaft 138 may include a paddle device 142 which may be constructed and arranged to mate with the keyholes 25, 38, 52 in the carrousel cartridge 20, a variation of which is illustrated in FIG. 6. The vertical shaft 138 may be constructed and arranged so that when the knob or button 132 is pushed, the trap door slide 100 may be moved from a first position to a second position which may expose the opening 40 from the bottom compartment 30 of the carrousel cartridge 20 so that one or more components 58 may be released from the carrousel cartridge(s) 20. As the knob or button 132 is pushed, the cam 134 may rotate the vertical shaft 138 which may cause the paddle device 142, which may be operatively connected to the inner case 44 of one or more carrousel cartridges 20, to rotate the inner case 44 causing one or more components 58 inside of the carrousel cartridge 20 to rotate so that the next component(s) 58 may be in position to be released from the carrousel cartridge 20 the next time the knob or button 132 is pressed. When the knob or button 132 is released, the spring operatively attached to the trap door slide 100 may cause the trap door slide 100 to move back to the first position which may close the opening 40 between the carrousel cartridge 20 and the carrousel cartridge dispenser 64 which may prevent any components 58 from dispensing from the carrousel cartridge 20.

In a number of variations, one or more carrousel cartridges 20 may be attached to the carrousel cartridge dispenser 64. In one variation, the back plate 90 on the housing 66 may include a cutout 96 which may be constructed and arranged to mate with the protrusion 42 and tab 28 on the top and bottom compartments 22, 30 of the one or more carrousel cartridge(s) 20 which may assist in holding the one or more carrousel cartridges 20 in place, a variation of which is illustrated in FIG. 5.

In a number of variations, the housing body 68 may also include a first pillar 80 which may extend adjacent from a first front corner 86 of the top surface 84 of the housing body 68 and a second pillar 82 may extend adjacent from a second front corner 88 of the top surface 84 of the housing body 68, a variation of which is illustrated in FIG. 5. In a number of variations, the first and second pillars 80, 82 may be constructed and arranged to further hold the one or more carrousel cartridges 20 in place. The first and second pillars 80, 82 may be any number of shapes including, but not limited to, cylindrical or square. In another variation, three or more pillars may be used to hold the carrousel cartridges 20 in place, or a single pillar may be used to hold the carrousel cartridge(s) 20 in place. In another variation, the one or more pillars 80, 82 may be contoured to match the shape of the one or more carrousel cartridges 20, not illustrated.

In a number of variations, one or more carrousel cartridges 20 may be attached to the carrousel cartridge dispenser 64 so that the opening 40 in the bottom compartment 30 lines up with the opening 72 in the carrousel cartridge dispenser housing 66. An operator may then manually press the knob or button 132 on the carrousel cartridge dispenser 64 to release one or more components 58 from the one or more carrousel cartridges 20.

In a number of variations, the carrousel cartridge dispenser 64 may be used to assist an operator in the assembly of the components 58 with limited operator interaction. In a number of variations, a carrousel cartridge dispenser 64 may improve ergonomics for operators by presenting components 58 to the operator without the operator having to pick individual components from boxes with limited finger clearance. The carrousel cartridges 20 and carrousel cartridge dispenser 64 may also allow for synchronous indexing/dispensing of components 58 to an operator without the operator having to assembly the individual components together. The carrousel cartridges 20 and carrousel cartridge dispenser 64 may also provide an operator with properly oriented components 58 when dispensed which may eliminate the need for pre-assembly kitting of components 58. The use of the carrousel cartridge dispenser 64 may also reduce the incidence of operators dropping components 58 which may damage the components 58 or expose the components 58 to contaminants and may also improve cycle times by reducing delays due to dropping and/or fumbling of parts.

The following description of variants is only illustrative of components, elements, acts, products and methods considered to be within the scope of the invention and are not in any way intended to limit such scope by what is specifically disclosed or not expressly set forth. The components, elements, acts, products and methods as described herein may be combined and rearranged other than as expressly described herein and still are considered to be within the scope of the invention.

Variation 1 may include a product comprising: a carrousel cartridge comprising: a bottom compartment; an inner case, wherein the inner case is rotatably attached to the bottom compartment and is constructed and arranged to accommodate at least one component; and a top compartment, wherein the top compartment and the bottom compartment are slideably attached together.

Variation 2 may include a product as set forth in Variation 1 wherein at least one of the top compartment, the bottom compartment, or the inner case includes an opening constructed and arranged to release at least one component from the carrousel cartridge.

Variation 3 may include a product as set forth in any of Variations 1-2 wherein at least one of the top compartment, the bottom compartment, or the inner casing includes a keyhole.

Variation 4 may include a product as set forth in any of Variations 1-3 wherein the carrousel cartridge is constructed and arranged to seal the at least one component inside when in a closed position.

Variation 5 may include a product as set forth in any of Variations 1-4 wherein the at least one component includes at least one of a transmission valve body spring, a valve, or a cap component.

Variation 6 may include a product as set forth in any of Variations 1-5 wherein the carrousel cartridge is operatively connected to a carrousel cartridge dispenser.

Variation 7 may include a product as set forth in Variation 6 wherein the carrousel cartridge dispenser comprises: a housing; an indexing cam system, wherein the indexing cam system is disposed within the housing; and a dispenser trough, wherein the dispenser trough is attached to the housing.

Variation 8 may include a product as set forth in any of Variations 6-7 wherein the carrousel cartridge dispenser is constructed and arranged to dispense one or more components from the carrousel cartridge when activated.

Variation 9 may include a product comprising: a carrousel cartridge dispenser comprising: a housing; an indexing cam system, wherein the indexing cam system is disposed within the housing; and a dispenser trough, wherein the dispenser trough is attached to the housing.

Variation 10 may include a product as set forth in Variation 9 wherein the housing is constructed and arranged to accommodate at least one carrousel cartridge.

Variation 11 may include a product as set forth in any of Variations 9-10 wherein the carrousel cartridge dispenser is constructed and arranged to dispense at least one component from at least one carrousel cartridge.

Variation 12 may include a product as set forth in any of Variations 9-11 wherein the housing is constructed and arranged to attach to an assembly station.

Variation 13 may include a product as set forth in any of Variations 9-12 wherein the indexing cam system comprises: a spring-loaded trap door slide; a cam operatively coupled to the spring-loaded trap door slide; a shaft, wherein the shaft is operatively coupled to the cam; and a knob, wherein the knob is attached to the spring-loaded trap door slide.

Variation 14 may include a product as set forth in any of Variations 9-13 wherein when the knob is pushed, the spring-loaded trap door slide is moved from a first position to a second position causing the shaft to turn a paddle on the shaft, and wherein in the second position, an opening in the spring-loaded trap door is exposed.

Variation 15 may include a product as set forth in any of Variations 9-14 further comprising at least one carrousel cartridge operatively connected to the carrousel cartridge dispenser.

Variation 16 may include a product as set forth in Variation 15 wherein the at least one carrousel cartridge comprises: a bottom compartment; an inner case, wherein the inner case is rotatably attached to the bottom compartment and is constructed and arranged to accommodate at least one component; and a top compartment, wherein the top compartment and the bottom compartment are slideably attached together; and wherein the bottom compartment and inner case are each constructed and arranged to mate with the indexing cam system.

Variation 17 may include a product as set forth in any of Variations 15-16 wherein when the carrousel cartridge dispenser is activated, at least one component is released from the at least one carrousel cartridge into the dispenser trough.

Variation 18 may include a method comprising: assembly of components comprising: providing at least one carrousel cartridge to hold at least one component; operatively connecting the at least one carrousel cartridge to a carrousel cartridge dispenser; and activating the carrousel cartridge dispenser to dispense the at least one component into a trough in the carrousel cartridge dispenser.

Variation 19 may include a method as set forth in Variation 18 wherein the at least one carrousel cartridge comprises a bottom compartment; an inner case, wherein the inner case is rotatably attached to the bottom compartment and is constructed and arranged to accommodate at least one component; and a top compartment, wherein the top compartment and the bottom compartment are slideably attached together.

Variation 20 may include a method as set forth in any of Variations 18-19 wherein the carrousel cartridge dispenser comprises a housing; an indexing cam system, wherein the indexing cam system is disposed within the housing; and a dispenser trough, wherein the dispenser trough is attached to the housing.

The above description of select variations within the scope of the invention is merely illustrative in nature and, thus, variations or variants thereof are not to be regarded as a departure from the spirit and scope of the invention.

What is claimed is:

1. A product comprising:

a carrousel cartridge dispenser comprising:

a housing comprising a top surface, a bottom surface, and at least one side surface extending therebetween defining an internal cavity, wherein a support wall extends perpendicularly from the at least one side surface and defines a channel with the top surface, and wherein the top surface includes an opening defined by an inner surface of the top surface which extends through the top surface, perpendicular to the support wall;

an indexing cam system disposed at least partially within the housing, wherein the indexing cam system comprises a spring-loaded trap door slide, and wherein the spring-loaded trap door slide extends within the channel and is constructed and arranged to move axially within the channel, wherein a first end of the spring-loaded trap door slide includes a first opening defined by an inner surface of the spring-loaded trap door slide which extends through the spring-loaded trap door slide, perpendicular to the support wall, and a second end of the spring-loaded trap door slide includes a second opening constructed and arranged to accommodate a cam; the cam operatively coupled to the spring-loaded trap door slide; a shaft, wherein the shaft is operatively coupled to the cam; and a knob, wherein the knob is attached to a front surface of the spring-loaded trap door slide, and wherein when the knob is pushed, the spring-loaded trap door slide is moved axially from a first position to a second position causing the cam to turn, rotating the shaft so that the shaft rotates a paddle on the shaft, and wherein in the second position, the opening in the spring-loaded trap door slide is constructed and arranged to align with the opening in the top surface; and a dispenser trough, wherein the dispenser trough is attached to the housing.

2. The product of claim 1 wherein the housing is constructed and arranged to accommodate at least one carrousel cartridge.

3. The product of claim 1 wherein the carrousel cartridge dispenser is constructed and arranged to dispense at least one component from at least one carrousel cartridge.

4. The product of claim 1 wherein the housing is constructed and arranged to attach to an assembly station.

5. The product of claim 1 further comprising at least one carrousel cartridge operatively connected to the carrousel cartridge dispenser.

6. The product of claim 5 wherein the at least one carrousel cartridge comprises: a bottom compartment; an inner case, wherein the inner case is rotatably attached to the bottom compartment and is constructed and arranged to accommodate at least one component; and a top compartment, wherein the top compartment and the bottom compartment are slideably attached together; and wherein the bottom compartment and inner case are each constructed and arranged to mate with the indexing cam system.

7. The product of claim 5 wherein when the carrousel cartridge dispenser is activated, at least one component is released from the at least one carrousel cartridge into the dispenser trough.

8. The product of claim 1 wherein the housing further includes a back plate constructed and arranged to attach to an assembly station.

* * * * *